United States Patent [19]

van Beek

[11] Patent Number: 4,716,600

[45] Date of Patent: Jan. 5, 1988

[54] POCKET LOSS PREVENTION GUARD

[76] Inventor: Gys J. van Beek, Rte. 9, Box 71, Caldwell, Id. 83605

[21] Appl. No.: 12,622

[22] Filed: Feb. 9, 1987

[51] Int. Cl.[4] ..... A41D 27/20

[52] U.S. Cl. ..... 2/250

[58] Field of Search ..... 2/250, 247

[56] References Cited

U.S. PATENT DOCUMENTS 626,728 7/1899 Smith ..... 2/250

674,916 5/1901 Graham ..... 2/250

*Primary Examiner*—Peter Nerbun

*Attorney, Agent, or Firm*—Paul F. Horton

[57] ABSTRACT

A loss prevention guard for pockets which includes a flat, resilient, insert having a bowed central portion and a pair of substantially planar end portions. The hem of a pocket, adjacent the mouth of the pocket, is provided with a pair of spaced slots into which the ends of the insert are inserted, leaving the central bowed portion of the insert bowed inwardly into contact with the clothing to which the pocket is attached, i.e., the back of the pocket. The bowed central portion of the insert is preferably provided with an abrasive having a high friction contact with the article to be guarded, for example a wallet, to prevent the article from slipping by the insert.

11 Claims, 6 Drawing Figures

POCKET LOSS PREVENTION GUARD

BACKGROUND OF THE INVENTION

1. Field of the Invention

This invention relates to loss prevention devices in general, and, more specifically, to devices attachable to clothing to prevent loss from pockets.

2. Description of the Prior Art

The desire to prevent loss of objects, such as wallets, from pockets of clothing of the wearer is obvious. To prevent such loss, buttons, snaps, and zippers for pockets are well known. Unfortunately, such loss prevention devices always require closure for securing the article and opening for obtaining the article. Because of this inconvenience, as well as for the sake of appearance, many garments such as the common jeans are not provided with closures.

In attempting to prevent loss of wallets and the like, where conventional closures are not provided on the pockets of the clothing, the art has largely centered on providing the article itself, i.e., the wallet, with its own loss prevention means. Typical of such devices are the plunger of W. A. Miller, U.S. Pat. No. 1,254,426; the spring wires of C. J. Davis, U.S. Pat. No. 1,404,278 and S. F. Gilmore, U.S. Pat. No. 1,446,293; the clips of W. C. Kahn, U.S. Pat. No. 1,555,714 and G. B. Shively, U.S. Pat. No. 2,126,826; and the spreaders of G. Woolf, U.S. Pat. No. 3,346,030 and W. J. Bortle, U.S. Pat. No. 3,462,801.

Such devices do not attach readily to the articles, such as wallets, and are, themselves, cumbersome and therefore impractical.

SUMMARY OF THE INVENTION

The present invention overcomes these problems of the prior art in providing a loss prevention insert which is attached easily and temporarily to the pocket itself by means of two laterally spaced slots located within the hem of the pocket adjacent the mouth of the pocket. The insert is in the form of a flat bow, having planar end portions and a bowed central portion. The insert is also resilient for convenient placement within the hem and also to maintain an inward bias of the bowed portion against the clothing to prevent accidental loss or theft. The bowed portion includes an abrasive, i.e., a substance having a high affinity for or a high frictional engagement with the article to be protected, such as a wallet, to prevent the article from slipping by the insert. The insert is removable for cleaning and pressing of the clothing as well as for other purposes.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
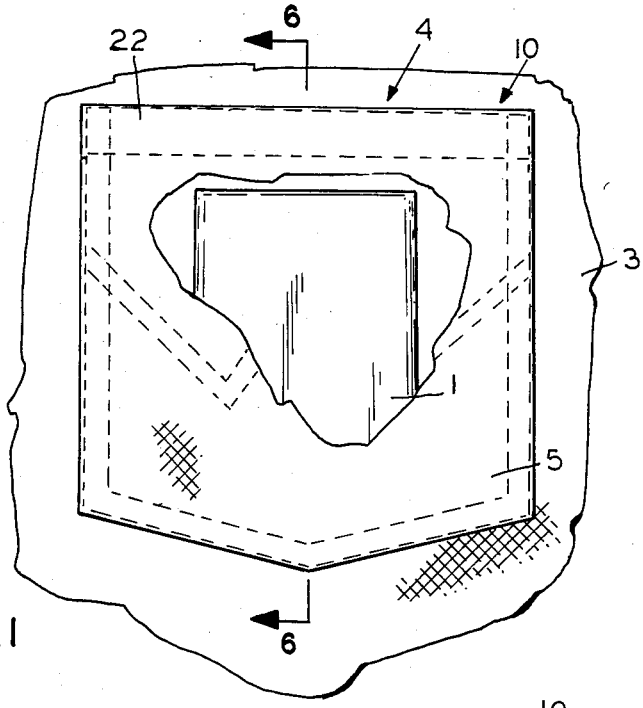
FIG. 1 is a rear view of a pocket, in partial section, showing the insert of the present invention in place to prevent loss of a wallet.
Figure 6:
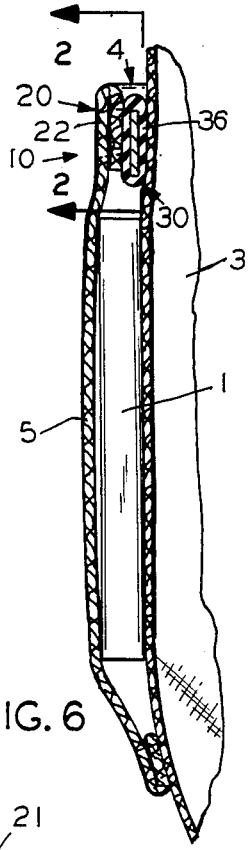
FIG. 6 is a sectional view taken along lines 6—6 of FIG. 1.

Referring now to the drawings, an embodiment to be preferred of the pocket loss prevention guard 10, made according to the present invention, is disclosed. Guard 10 includes insert retention means, designated generally by the numeral 20 and an insert 30.

Figure 5:
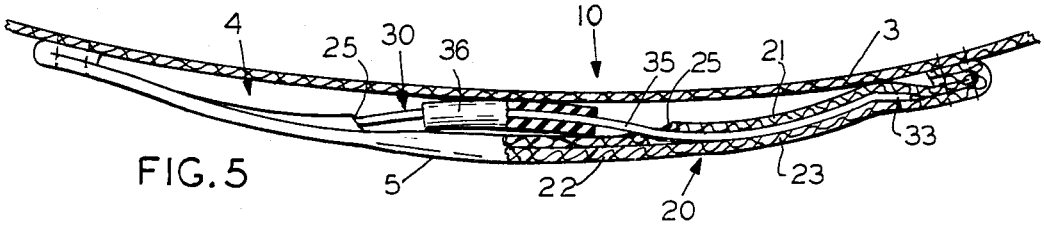
FIG. 5 is a sectional view taken along lines 5—5 of FIG. 2.

Referring to FIGS. 1 and 5, in particular, insert retention means 20, as shown in the preferred embodiment, includes two laterally spaced slots 25 in hem 22 of pocket 5 adjacent mouth 4 of the pocket. The pocket is attached to any type of clothing 3, such as jeans and the like. Hem 22 is conventional, except for slots 25, it only being necessary that the hem be of adequate size for insertion of insert 30. As is conventional, hem 22 includes two layers 21 and 23 of a fabric folded upon itself and stitched to provide an enclosure between the stitch seams. Slots 25 are vertical slots, approximately one-half inch in length, cut through the inner layer 21, thus opening into the enclosure. The cuts may be stitched, in the manner of a button hole to strengthen the slots. The slots are preferably spaced about two inches apart.

Figure 3:
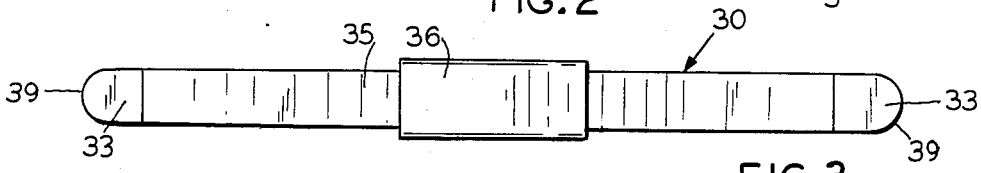
FIG. 3 is an elevational view of the insert of the present invention.
Figure 4:
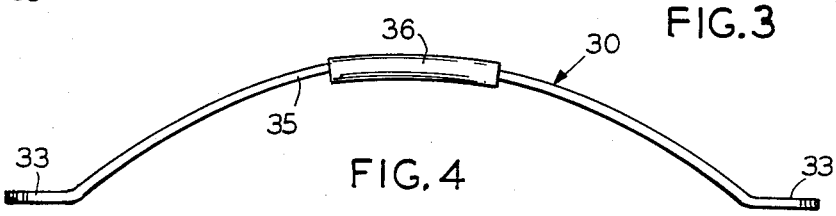
FIG. 4 is a plan view of the insert shown in FIG. 3.

Insert 30, shown to advantage in FIGS. 3 and 4, is preferably constructed of a resilient plastic material such as cellulose or polyethylene. Resilience is defined as that quality or characteristic which causes a substance to return to its original form after being distorted. Obviously, spring metal or the like would also be satisfactory. It is important that the insert be flat, both for comfort and to prevent rotation of the insert within the hem, as will hereinafter become obvious. It is preferred that the insert be approximately five to five and one-half inches in length, having a width of seven-sixteenth of an inch and a thickness of one-sixteenth of an inch for the ordinary hip pocket. The size, of course, is dependent upon the size of mouth 4 of the pocket.

The insert includes two end portions 33 and a central portion 35. The end portions are substantially planar with one another to prevent the insert from digging into the hem fabric and also for comfort of the wearer, being parallel with the hem. While not critical, the length of each end portion 33 is approximately one-half inch. Each of the end portions are provided with rounded edges 39, also for comfort. Central portion 35 is bowed to provide a constant inward bias of the insert itself as well as the hem 22 of the pocket toward clothing 3 to which the pocket is attached. In being resilient, the insert is readily flexed outwardly for one to obtain his wallet 1, but the pocket is kept in a closed condition at all other times due to the bias of the central portion.

Located on central portion 35 of the insert is abrasive means, designated by the numeral 36. The term "abrasive" is used in the context of having a high degree of frictional engagement with the article, such as wallet 1, contained within the pocket. In that the article will generally be a wallet, it is preferred that rubber, in the form of a band or tube approximately one and one-half inches in length about the central portion, be used as the abrasive means. It is also desirable that the abrasive means include a textured exterior surface for superior gripping of the wallet, thus increasing the frictional contact between the insert and the wallet. It is evident that where the insert is constructed of a single piece of plastic material, that the central portion can be roughened to provide an abrasive surface.

Figure 2:
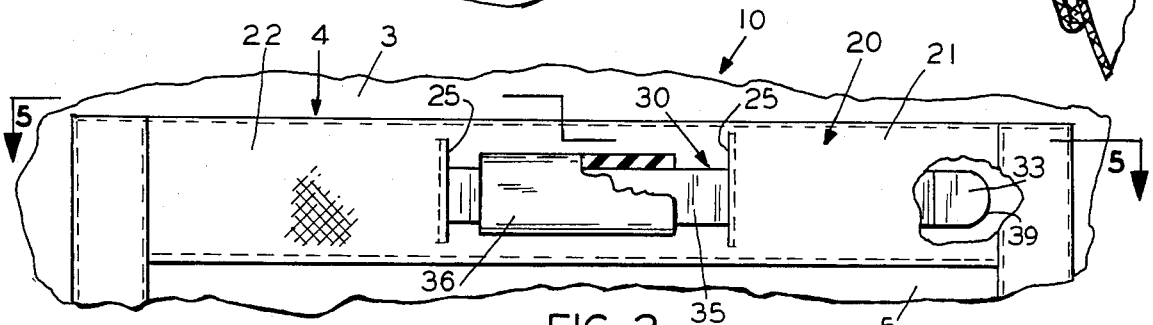
FIG. 2 is a partial view of the back of a pocket as viewed from within the pocket, showing the insert in place.

Referring now to FIGS. 2 and 5, placement position of insert 30 into retention means 20 may be seen to advantage. One of the end members 33 is inserted into one of the slots 25 with the convex surface of bowed central portion 35 facing the clothing 3, otherwise conventionally known as the rear surface of the pocket. The insert is then flexed to permit insertion of the other end member into the remaining slot so that both end members and a part of each side of central portion 35 is contained within the enclosure defined by hem 22, i.e., between fabric layers 21 and 23 of the hem. Such insertion leaves the middle part of central portion 35 exposed to engage the rear of the pocket. Where abrasive means 36 is used, as is preferred, the abrasive material engages clothing 3, i.e., the back of the pocket, and also frictionally engages wallet 1, should the wallet be moved toward mouth 4 of the pocket, to prevent accidental loss or theft of the wallet. If the wallet is to be removed from the pocket, one simply grasps the wallet, pulling upward, while the back of the hand exerts a pressure on the insert to press the insert outwardly to expand mouth 4 of the pocket. In replacing the wallet, the hand once again expands the mouth of the pocket by flexing insert 30 outwardly and the wallet is then dropped into place.

Having thus described in detail a preferred embodiment of the present invention, it is to be appreciated and will be apparent to those skilled in the art that many physical changes could be made in the pocket loss prevention guard without altering the inventive concepts and principles embodied therein. The present embodiment is therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. A loss prevention guard for clothing of the type having one or more pockets, said guard comprising:

insert retention means located at the mouth of a pocket; and an insert held in place by said retention means, said insert including two end portions and a central resilient bowed portion therebetween for holding the pocket in a closed position with the bowed portion biased toward the clothing to which the pocket is affixed to prevent loss of articles within the pocket.

2. The loss prevention guard as described in claim 1 wherein said bowed portion is provided with abrasive means to prevent articles within the pocket from slipping by said insert.

3. The loss prevention guard as described in claim 2 wherein said abrasive means is constructed of rubber.

4. The loss prevention guard as described in claim 3 wherein said abrasive means is in the form of a band about said bowed portion.

5. The loss prevention guard as described in claim 1 wherein said insert retention means comprises a hem having two fabric layers defining an enclosure and wherein said hem includes two laterally spaced slots for receiving said insert.

6. A loss prevention guard for clothing of the type having one or more pockets, said loss prevention guard comprising:

insert retention means located at the mouth of one or more pockets; and an insert held in place by said retention means of a respective pocket, said insert comprising two opposing end portions and a flat resilient central bowed portion, said bowed portion biased toward clothing to which the pocket is attached and including abrasive means to prevent articles within a pocket from slipping by said insert.

7. The loss prevention guard as described in claim 6 wherein said insert retention means comprises a hem of the pocket adjacent the mouth of the pocket, said hem provided with two laterally spaced slots, each slot operable to receive one of said end members of said insert.

8. A loss prevention guard for clothing of the type having one or more pockets, said loss prevention guard comprising:

insert retention means, said means including a hem of a pocket adjacent the mouth of the pocket, said hem provided with two laterally spaced, substantially vertical slots; and an insert comprising a pair of flat end members having rounded edges, each of said members substantially planar with each other, and a resilient bowed portion therebetween, each of said end members receivable within one of said slots of said hem, said bowed portion being bowed inwardly to engage said clothing to which the pocket is attached to prevent loss of an article contained within the pocket.

9. The loss prevention guard as described in claim 8 wherein said bowed portion of said insert is provided with abrasive means operable to abrasively engage an article with the pocket to prevent the article from slipping by said bowed portion of said insert.

10. The loss prevention guard as described in claim 9 wherein said abrasive means includes a rubber band surrounding at least a part of said bowed portion of said insert.

11. The loss prevention guard as described in claim 10 wherein said rubber band includes a textured exterior surface.

* * * * *